US010640727B2

(12) United States Patent
Greaves et al.

(10) Patent No.: US 10,640,727 B2
(45) Date of Patent: May 5, 2020

(54) CORROSION RESISTANT LUBRICANT

(71) Applicant: DOW GLOBAL TECHNOLOGIES LLC, Midland, MI (US)

(72) Inventors: Martin R. Greaves, Horgen (CH); Jiangbo Ma, Shanghai (CN)

(73) Assignee: Dow Global Technologies LLC, Midland, MI (US)

( * ) Notice: Subject to any disclaimer, the term of this patent is extended or adjusted under 35 U.S.C. 154(b) by 0 days.

(21) Appl. No.: 15/124,723

(22) PCT Filed: Mar. 18, 2014

(86) PCT No.: PCT/CN2014/073624

§ 371 (c)(1),
(2) Date: Sep. 9, 2016

(87) PCT Pub. No.: WO2015/139209

PCT Pub. Date: Sep. 24, 2015

(65) Prior Publication Data

US 2017/0073611 A1 Mar. 16, 2017

(51) Int. Cl.
*C10M 169/04* (2006.01)
*C10M 133/44* (2006.01)

(52) U.S. Cl.
CPC ..... *C10M 169/044* (2013.01); *C10M 133/44* (2013.01); *C10M 2207/026* (2013.01); *C10M 2207/283* (2013.01); *C10M 2207/2835* (2013.01); *C10M 2209/1033* (2013.01); *C10M 2209/1055* (2013.01); *C10M 2209/1075* (2013.01); *C10M 2215/064* (2013.01); *C10M 2215/223* (2013.01); *C10M 2219/044* (2013.01); *C10N 2210/02* (2013.01); *C10N 2220/021* (2013.01); *C10N 2230/12* (2013.01); *C10N 2230/36* (2013.01); *C10N 2230/40* (2013.01); *C10N 2240/30* (2013.01)

(58) Field of Classification Search
CPC ..... C10M 2205/0245; C10M 107/06; C10M 107/08
USPC ..... 508/199, 280
See application file for complete search history.

(56) References Cited

U.S. PATENT DOCUMENTS 6,127,324 A * 10/2000 Tolfa ..... C10M 111/04 508/463
2006/0135377 A1* 6/2006 Li ..... C10M 173/025 508/389
2007/0004605 A1* 1/2007 Matsumura ..... C10M 111/04 508/577
2011/0039739 A1 2/2011 Greaves et al.
2011/0065618 A1* 3/2011 Tagawa ..... C10M 169/04 508/382
2013/0157909 A1 6/2013 Greaves et al.
2014/0107004 A1 4/2014 Khelidj et al.
2015/0048271 A1 2/2015 Kaneko et al.

FOREIGN PATENT DOCUMENTS

WO 2013070913 5/2013

OTHER PUBLICATIONS

International Search Report & Written Opinion for related PCT Application PCT/CN2014/073624, dated Dec. 22, 2014 (13 pgs).
International Preliminary Report on Patentability for related PCT Application PCT/CN2014/073624, dated Sep. 29, 2016 (6 pgs).

* cited by examiner

*Primary Examiner* — Prem C Singh
*Assistant Examiner* — Francis C Campanell
(74) *Attorney, Agent, or Firm* — Brooks, Cameron & Huebsch, PLLC

(57) ABSTRACT

A lubricant contains alcohol initiated propylene oxide homopolymer, an oil soluble polyalkylene glycol other than the alcohol initiated propylene oxide homopolymer, and a calcium salt of dinonylnaphthalene sulphonate where the lubricant is further characterized by containing less than ten weight-percent of polyol esters based on total lubricant weight is useful as a lubricant for compressors.

11 Claims, No Drawings

CORROSION RESISTANT LUBRICANT

BACKGROUND OF THE INVENTION

Field of the Invention

The present invention relates to lubricants containing polyalkylene glycol base oil, a separate oil-soluble polyalkylene glycol and a calcium salt of dinonylnaphthalene sulphonate.

Introduction

Modern rotary screw air compressor (RSAC) lubricants generally comprise a synthetic polyalkylene glycol (PAG) as a dominant base oil along with a polyol ester co-base oil at a lesser concentration. The PAG component is generally an alcohol initiated propylene oxide homopolymer. The PAG tends to cause some elastomeric components such as acrylonitrile butadiene rubbers (NBR) to shrink. Elastomers such as NBR are commonly used in compressor equipment in roles such as gaskets. It is undesirable for a lubricant to shrink elastomeric gaskets in contact with the lubricant because that can cause lubricant leakage. In contrast, it can be desirable for a lubricant to slightly swell elastomeric gaskets to prevent lubricant leakage. The polyol ester co-base oil serves to help swell elastomeric compounds thereby counter-balancing the shrinking effect of the PAG. The polyol ester co-base oil also acts as a ferrous corrosion inhibitor booster. Ferrous corrosion inhibitors are typically included in RSAC lubricants and the polyol ester co-base oil boosts the corrosion resistance performance of the ferrous corrosion inhibitor additive.

The PAG/polyol ester lubricant typically offers exceptional fluid life in most RSAC environments. For example, PAG/polyol ester lubricants have fluid change intervals of about 8000 hours while conventional mineral oil RSAC lubricants have fluid change intervals of about 2000 hours.

A problem for the PAG/polyol ester lubricant occurs when the RSAC operates in an atmosphere containing acidic gases such as sulfur dioxide. Water and acidic gases can ingress from such an atmosphere into the lubricant and cause hydrolysis of the polyol ester, resulting in a shortened fluid life. In high acid environments, the PAG/polyol ester lubricants can have a lifetime of less than 2000 hours.

An added difficulty in the art of PAG-based RSAC lubricants is that the corrosion inhibitor is typically a barium-containing additive. Barium components are not desirable for the environment so an alternative additive is desirable.

It is desirable to find a RSAC lubricant based on a PAG base oil that does not require polyol ester co-base oil or a barium-containing corrosion inhibitor yet that still has corrosion resistance comparable or better than polyol ester formulations.

BRIEF SUMMARY OF THE INVENTION

The present invention offers a PAG-based RSAC lubricant that does not require polyol ester co-base oil or a barium-containing corrosion inhibitor yet that has corrosion resistance comparable or better than polyol ester formulations. The lubricant of the present invention uses an alcohol-initiated propylene oxide homopolymer as the base oil and an oil soluble PAG other than the alcohol-initiated propylene oxide homopolymer as a co-base oil. The lubricant of the present invention further includes a calcium salt of dinonylnaphthalene sulphonate as a ferrous corrosion inhibitor.

The present invention is a result of discovering that oil soluble PAGs can swell elastomers similar to polyol esters and that calcium salts of dinonylnaphthalene sulphonate, when included in the lubricant of the present invention, can serve as a ferrous corrosion inhibitor with results as good as the barium-containing inhibitors, but without the barium-containing inhibitors. Surprisingly, the oil soluble PAG and calcium salt of dinonylnaphthalene sulphonate have a synergistic effect that results in an increased corrosion resistance.

In a first aspect, the present invention is a lubricant comprising alcohol initiated propylene oxide homopolymer, an oil soluble polyalkylene glycol other than the alcohol initiated propylene oxide homopolymer, and a calcium salt of dinonylnaphthalene sulphonate where the lubricant is further characterized by containing less than ten weight-percent of polyol esters based on total lubricant weight.

In a second aspect, the present invention is a method for lubricating a compressor, the method comprising the step of adding to the compressor the lubricant of the first aspect.

The lubricant of the present invention is useful in the method of the present invention for lubricating machinery such as a rotary screw air compressor.

DETAILED DESCRIPTION OF THE INVENTION

"And/or" means "and, or alternatively". All ranges include endpoints unless otherwise stated.

Test methods refer to the most recent test method as of the priority date of this document unless a date is indicated with the test method number as a hyphenated two digit number. References to test methods contain both a reference to the testing society and the test method number. Test method organizations are referenced by one of the following abbreviations: ASTM refers to ASTM International (formerly known as American Society for Testing and Materials); EN refers to European Norm; DIN refers to Deutsches Institute für Normung; and ISO refers to International Organization for Standards.

The lubricant of the present invention comprises alcohol initiated propylene oxide homopolymer. Formula I presents the general formula for the alcohol initiated propylene oxide homopolymer:

$$R_1[O(CH_2CH(CH_3)O)_mR_2]_n \qquad \text{I}$$

Where $R_1$ corresponds to the backbone of an alcohol initiator (the residual component other than hydroxyl group or groups that have been reacted with propylene oxide); $R_2$ is selected from a group consisting of hydrogen and alkyl, aryl and alkyl aryl groups containing from 1 to 18 carbons; m corresponds to the average number of propylene oxide molecules polymerized onto a hydroxyl group of the alcohol initiator and is generally 10 or higher and at the same time 40 or smaller, preferably 15 or smaller; and n is the number of poly propylene oxide chains extending from the alcohol initiator backbone and is equal to the number of hydroxyl groups on the alcohol initiator that react with propylene oxide during polymerization. The value of n is generally one, two or three depending on whether the initiator is a monol, diol or triol respectively. The initiator is desirably a monol (n equals one), and preferably the alcohol initiator is butanol, which means $R_1$ is a four carbon alkyl.

The alcohol initiated propylene oxide homopolymer desirably has a kinematic viscosity at 100° C. of 5 centiStokes (cSt) or greater, preferably six cSt or greater, and can be seven cSt or greater and even eight cSt or greater. At the same time, the alcohol initiated propylene oxide homopolymer desirably has a kinematic viscosity at 100 degrees Celsius (° C.) of 15 cSt or less. Determine kinematic viscosity according to ASTM D445.

The alcohol initiated propylene oxide homopolymer desirably is present at a concentration of more than 50 weight-percent (wt %), more preferably 60 wt % or more, still more preferably 70 wt % or more, even more preferably 75 wt % or more and can be present at a concentration of 80 wt % or more, 85 wt % or more, even 90 wt % or more based on total lubricant weight. At the same time, the alcohol initiated propylene oxide homopolymer is typically present at a concentration of 98 wt % or less, more typically 95 wt % or less and can be 90 wt % or less, 85 wt % or less, and even 75 wt % or less based on the total lubricant weight. Notably, the alcohol initiated propylene oxide homopolymer can be a blend of two or more alcohol initiated propylene oxide homopolymers, in which case the wt % alcohol initiated propylene oxide homopolymer corresponds to the combined weight of all alcohol initiated propylene oxide homopolymers.

The present invention further comprises an oil soluble polyalkylene glycol (OSP) other than the alcohol initiated propylene oxide homopolymer. The OSP is desirably selected from a group consisting of alcohol initiated butylene oxide homopolymers and alcohol initiated copolymers of butylene oxide and propylene oxide. Preferably, the OSP is one or more than one alcohol initiated copolymer of butylene oxide and propylene oxide. The copolymer can be a random copolymer or a block copolymer. When a block copolymer, the butylene oxide and propylene oxide can be polymerized in either order to form a PO/BO or a BO/PO block copolymer extending off from the alcohol initiator, where "PO" refers to ring opened (polymerized) propylene oxide component and "BO" refers to ring opened (polymerized) butylene oxide component left after polymerization. Desirably, the OSP is an alcohol initiated PO/BO random copolymer. The amount of BO is desirably 40 weight-percent (wt %) or more, preferably 50 wt % or more and can be 60 wt % or more, 65 wt % or more and even 70 wt % or more and at the same time is typically 80 wt % or less and can be 70 wt % or less based on the total weight of PO and BO. Desirably, the OSP is 50 wt % PO and 50 wt % BO based on total weight of PO and BO (that is, PO and BO are copolymerized at a 50/50 weight ratio).

The OSP is desirably prepared from an alcohol initiator having 8 carbons or more, preferably 10 carbons or more, still more preferably 12 carbons or more, more preferably 14 carbons or more and can be 16 carbons or more and even 18 carbons or more while at the same time typically having 20 carbons or fewer. At the same time, the initiator is desirably linear and more preferably a primary alcohol. One particularly desirable alcohol initiator for preparing the OSP is dodecanol.

The alcohol initiator for the OSP can be a monol, diol or triol. Preferably, the alcohol initiator is a monol.

The OSP can be terminated with a hydrogen (H) to form a terminal alcohol (hydroxyl) linkage or can be capped with a group other than hydrogen, preferably to a carbon atom, to form linkages such as those selected from ethers and esters. The termination linkage is on the opposite end of the OSP from the alcohol initiator.

The OSP generally has a kinematic viscosity at 40° C. of 15 cSt or higher, preferably 18 cSt or higher, more preferably 32 cSt or higher, and can be 68 cSt or higher, 80 cSt or higher, 100 cSt or higher, 150 cSt or higher and even 220 cSt or higher while at the same time is generally 250 cSt or lower. Determine kinematic viscosity according to ASTM D445.

The OSP generally has an average molecular weight of 500 grams per mole (g/mol) or more, preferably 750 g/mol or more, and can be 1000 g/mol or more, 1250 g/mol or more, 1500 g/mol or more, 1900 g/mol or more, or 2400 g/mol or more and at the same time is generally 3600 g/mol or less, preferably 2400 g/mol or less and more preferably 1900 g/mol or less and even more preferably 1400 g/mol or less and most preferably less than 1400 g/mol. Determine average molecular weight according by gel permeation chromatography. Unless otherwise indicated, "molecular weight" refers to number average molecular weight (Mn).

When the OSP has an average molecular weight of 1400 g/mol is tends to neither swell nor shrink acrylonitrile butadiene rubber (NBR) and when it has an average molecular weight of less than 1400 g/mol it tends to swell NBR. OSPs having an average molecular weight greater than 1400 g/mol can shrink NBR rubber. It is desirable for a lubricant not to shrink gaskets made of NBR rubber and most desirable to slightly well such gaskets when in contact with the lubricant so to prevent lubricant leakage around the gasket seals.

The concentration of OSP is generally two wt % or more, preferably five wt % or more and can be ten wt % or more, 15 wt % or more and even 20 wt % or more while at the same time is typically 30 wt % or less, and generally 25 wt % or less or even 20 wt % or less based on total lubricant weight.

The present invention is a result of discovering that part or all of the polyol ester that is in a typical lubricant formulation can be replaced with OSP for a more stable lubricant. In that regard, the concentration of polyol esters is less than ten wt % and is preferably five wt % or less and even more preferably three wt % or less based on total lubricant weight. The lubricant can be free of polyol esters. Polyol esters include alkanoic esters such as alkanoic esters of hindered polyhydric alcohols having 3-8 hydroxyl groups.

The present invention further comprises a calcium salt of dinonylnaphthalene sulphonate as a corrosion inhibitor. There is a surprising synergy that appears to occur with the lubricant formulation when the corrosion inhibitor is a calcium salt of dinonylnaphthalene sulphonate. Lubricant formulations of the present invention more readily pass corrosion testing under ASTM D665-12 with a calcium salt of dinonylnaphthalene sulphonate than a similar formulation with different corrosion inhibitors such as a barium salt of dinonylnaphthalene sulphonate.

Desirably, the concentration of the calcium salt of dinonylnaphthalene sulphonate is present at a concentration of 0.1 wt % or more, preferably 0.2 wt % or more, still more preferably 0.25 wt % or more, yet more preferably 0.5 wt % or more and can be 0.75 wt % or more, one wt % or more and even 1.5 wt % or more while at the same time is typically five wt % or less, preferably three wt % or less and can be two wt % or less and even one wt % or less based on total lubricant weight.

A benefit of the present invention is that it does not require barium-containing materials such as barium-based corrosion inhibitors. In fact, lubricants of the present invention can contain less than 0.1 wt %, preferably 0.05 wt % or less, still more preferably 0.01 wt % or less and can be free of barium-containing materials with wt % relative to total lubricant weight.

The lubricant of the present invention is useful for lubricating mechanical devices, particularly compressors and more particularly rotary screw air compressors. The lubricant of the present invention can be added to a compressor as a lubricant in accordance with the instructions of the compressor. The present invention meets the needs of rotary screw air compressor lubricant without requiring the use of polyol esters or barium-containing materials.

EXAMPLES

The materials for the Examples (Exs) and Comparative Examples (Comp Exs) are listed in Tables 1 and 2. UCON is a trademark of Union Carbide Corporation. SYNALOX is a trademark of The Dow Chemical Company. SYNATIVE is a trademark of Cognis IP Management GmbH. IRGANOX is a trademark of BASF SE Company. VANLUBE is a trademark of R.T. Vanderbilt Minerals, LLC. SULLUBE is a trademark of Sullair Corporation. Na-Sul is a trademark of King Industries, Inc.

TABLE 1

| BASE OILS | Supplier | Chemistry |
|---|---|---|
| UCON ™ LB-165 | The Dow Chemical Company | Butanol initiated PO homo-polymer with a typical kinematic viscosity at 100° C. of 7 $mm^2/s$ (cSt) |
| UCON ™ LB-285 | The Dow Chemical Company | Butanol initiated PO homo-polymer with a typical kinematic viscosity at 100° C. of 11 $mm^2/s$ (cSt) |
| SYNALOX ™ 100-20B | The Dow Chemical Company | Butanol initiated PO homo-polymer with a typical kinematic viscosity at 100° C. of 6 $mm^2/s$ (cSt) |
| SYNALOX ™ 100-30B | The Dow Chemical Company | Butanol initiated PO homo-polymer with a typical kinematic viscosity at 100° C. of 8 $mm^2/s$ (cSt) |
| SYNALOX ™ PB-200 | The Dow Chemical Company | Butanol initiated PO homo-polymer with a typical kinematic viscosity at 100° C. of 8 $mm^2/s$ (cSt) |
| UCON ™ OSP-18 | The Dow Chemical Company | Dodecanol initiated random co-polymer (PO/BO, 50/50 by wt) with a typical kinematic viscosity at 40° C. of 18 $mm^2/s$ (cSt). Its average molecular weight (Mn) is 500 g/mol. |
| UCON ™ OSP-32 | The Dow Chemical Company | Dodecanol initiated random co-polymer (PO/BO, 50/50 by wt) with a typical kinematic viscosity at 40° C. of 32 $mm^2/s$ (cSt). Its average molecular weight (Mn) is 760 g/mol. |
| UCON ™ OSP-68 | The Dow Chemical Company | Dodecanol initiated random co-polymer (PO/BO, 50/50 by wt) with a typical kinematic viscosity at 40° C. of 68 $mm^2/s$ (cSt). Its average molecular weight is 1400 g/mol. |
| UCON ™ OSP-150 | The Dow Chemical Company | Dodecanol initiated random co-polymer (PO/BO, 50/50 by wt) with a typical kinematic viscosity at 40° C. of 150 $mm^2/s$ (cSt). Its average molecular weight (Mn) is 1900 g/mol. |
| UCON ™ OSP-220 | The Dow Chemical Company | Dodecanol initiated random co-polymer (PO/BO, 50/50 by wt) with a typical kinematic viscosity at 40° C. of 220 $mm^2/s$ (cSt). Its average molecular weight (Mn) is 2400 g/mol. |
| SYNATIVE ™ ES 2931 | BASF | A polyol ester derived from pentaerythritol and a mixture of short C5-C10 acids with a typical kinematic viscosity at 40° C. of 26 $mm^2/s$ (cSt). |

TABLE 2

| ADDITIVES | Supplier | Chemistry |
|---|---|---|
| Na-Sul ™ 611 Corrosion inhibitor | King Industries | Barium salt of dinonylnaphthalene sulphonate with an approximate total base number = 45 (as barium carbonate). |
| Na-Sul ™ BSN Corrosion inhibitor | King Industries | 50% barium salt of dinonylnaphthalene sulphonate. in a light mineral oil with a Barium content of 6.5-7.0%. |
| Na-Sul ™ Ca-1089 Corrosion inhibitor | King Industries | Calcium salt of dinonylnaphthalene sulphonate/carboxylate complex in a light mineral oil with a Calcium content of 2.2% |
| Na-Sul ™ Ca-50 Corrosion inhibitor | King Industries | Calcium salt of dinonylnaphthalene sulphonate with a total base number = 50 (as calcium carbonate) |
| IRGANOX ™ L57 Anti-oxidant | BASF | Alkylated diphenyl amine |
| IRGANOX ™L06 Anti-oxidant | BASF | Alkylated phenyl-alpha-naphthylamine (N-phenyl-1,1,3,3-tetramethylbutylnaphthalene-1 amine) |
| IRGANOX ™L135 Anti-oxidant | BASF | BENZENEPROPANOIC ACID, 3,5-BIS(1,1-DIMETHYLETHYL)-4-HYDROXY-,C7-9-BRANCHED ALKYL ESTERS (CAS No 125643-61-0) |
| VANLUBE ™ 961 Anti-oxidant | RT Vanderbilt | Alkylated diphenyl amine |
| SULLUBE ™ 32 Compressor oil | Sullair | A commercially available compressor lubricant comprising a blend of PAG (PO homo-polymer) and polyol ester in the approximate ratio 70/30 w/w. The product contains an additive package (<10%) comprising of additives such as anti-oxidants, yellow metal passivators, dyes, foam control additives etc and also contains a barium dinonylnaphthalene sulphonate corrosion inhibitor. |

Prepare formulations in a 500 milliliter (mL) glass beaker by adding each component of the formulation to obtain a 400 gram mixture. Stir the mixture for 60 minutes at 50° C. until clear and homogeneous and then allow to cool to approximately 23° C. All blends are clear and stable after storing for one week at 20-25° C.

Evaluate corrosion inhibition for the Ex and Comp Ex formulations according to ASTM D665-12 corrosion tests A and B. ASTM D665A is a corrosion test using deionized water. ASTM D665B is a corrosion test using synthetic sea water, and is more challenging to pass than ASTM D665A. The ASTM D665-12 method recommends conducting the test for four (4) or 24 hours. In some instances, the Exs and/or Comp Exs were actually tested for 48 hours. Formulations either pass (P) or fail (F) the corrosion tests.

Comp Exs A-D

Barium Salt Corrosion Inhibitor Formulations

Table 3 lists comparative example formulations using barium salt corrosion inhibitor along with corrosion test results for ASTM D665A testing for 24 hours. Numerical values are wt % of a 400 g formulation for each component. Corrosion test results are either pass (P) or fail (F).

TABLE 3

| Component | Comp Ex A | Comp Ex B | Comp Ex C | Comp Ex D |
|---|---|---|---|---|
| UCON Lubricant LB-165 | 66.08 | 75.98 | 66.98 | 57.98 |
| UCON Lubricant LB-285 | 0 | 8.4 | 7.4 | 6.4 |
| UCON OSP-32 | 0 | 10 | 20 | 30 |
| Vanlube 961 | 5 | 5 | 5 | 5 |
| Tolyltriazole | 0.12 | 0.12 | 0.12 | 0.12 |
| Synative ES 2931 | 28.3 | 0 | 0 | 0 |
| Na-Sul 611 | 0.5 | 0.5 | 0.5 | 0.5 |
| 24 hours Corrosion result-ASTM D665A | P | F | F | F |

Comp Ex A is a typical compressor lubricant that contains a PO homopolymer, a polyol ester and a barium corrosion inhibitor. Replacing the polyol ester (Synative ES 2931) with an alcohol initiated random PO/BO copolymer (UCON OSP-32) at various substitution levels ranging from 10-30 wt % causes the formulation to fail the ASTM D665A corrosion test.

Exs 1-9

Calcium Salt Corrosion Inhibitor Formulations

Table 4 lists example formulations using calcium salt corrosion inhibitor along with corrosion test results for ASTM D665A testing for 24 hours.

Table 5 lists comparative formulations using calcium salt corrosion inhibitor but without the OSP component (UCON OSP-32).

Numerical values are wt % of a 400 g formulation for each component. Corrosion test results are either pass (P) or fail (F).

Results show that the formulations with the combination of OSP and calcium salt corrosion inhibitor pass the ASTM D665A corrosion test, but samples with the calcium salt but not the OSP fail the ASTM D665A corrosion test. These results reveal a synergistic effect between the calcium salt corrosion inhibitor and the OSP in the formulation that favors passing the corrosion test.

TABLE 4

| Component | Ex 1 | Ex 2 | Ex 3 | Ex 4 | Ex 5 | Ex 6 | Ex 7 | Ex 8 | Ex 9 |
|---|---|---|---|---|---|---|---|---|---|
| SYNALOX PB-200 | 74.63 | 74.38 | 73.88 | 84.63 | 84.38 | 83.88 | 89.63 | 89.38 | 88.88 |
| UCON OSP-32 | 20 | 20 | 20 | 10 | 10 | 10 | 5 | 5 | 5 |
| VANLUBE 961 | 5 | 5 | 5 | 5 | 5 | 5 | 5 | 5 | 5 |
| Tolyltrizole | 0.12 | 0.12 | 0.12 | 0.12 | 0.12 | 0.12 | 0.12 | 0.12 | 0.12 |
| Na-Sul Ca-1089 | 0.25 | 0.5 | 1 | 0.25 | 0.5 | 1 | 0.25 | 0.5 | 1 |
| 24 hours Corrosion result-ASTM D665A | P | P | P | P | P | P | P | P | P |

TABLE 5

| Component | Comp Ex E | Comp Ex F | Comp Ex G |
|---|---|---|---|
| SYNALOX PB-200 | 94.63 | 94.38 | 93.88 |
| UCON OSP-32 | 0 | 0 | 0 |
| VANLUBE 961 | 5 | 5 | 5 |
| Tolyltrizole | 0.12 | 0.12 | 0.12 |
| Na-Sul Ca-1089 | 0.25 | 0.5 | 1 |
| 24 hours Corrosion result-ASTM D665A | F | F | F |

Exs 10-12 and Comp Exs H-J

ASTM D665B Testing

Table 6 lists formulations for Exs 10-12 and Comp Exs H-J and test results for ASTM D665B testing over 4 hours, 24 hours and 48 hours. The formulations all include calcium salt corrosion inhibitor. The Exs include OSP while the Comp Exs do not. Each of the formulations includes IRGANOX L57.

Results reveal that a greater degree of corrosion resistance is achieved when the OSP is present, again affirming a synergistic effect between the calcium salt and the OSP that favors corrosion inhibition.

Numerical values are wt % of a 400 g formulation for each component. Corrosion test results are either pass (P) or fail (F).

TABLE 6

| Component | Ex 10 | Ex 11 | Ex 12 | Comp Ex H | Comp Ex I | Comp Ex J |
|---|---|---|---|---|---|---|
| SYNALOX 100-20B | 37.315 | 37.19 | 36.94 | 47.315 | 47.19 | 46.94 |
| SYNALOX 100-30B | 37.315 | 37.19 | 36.94 | 47.315 | 47.19 | 46.94 |
| UCON OSP-32 | 20 | 20 | 20 | 0 | 0 | 0 |
| IRGANOX L57 | 5 | 5 | 5 | 5 | 5 | 5 |
| Tolyltriazole | 0.12 | 0.12 | 0.12 | 0.12 | 0.12 | 0.12 |
| Na-Sul Ca-1089 | 0.25 | 0.5 | 1 | 0.25 | 0.5 | 1 |
| Corrosion result ASTM D665B | | | | | | |
| 4 hours | P | P | P | F | P | P |
| 24 hours | F | P | P | F | F | F |
| 48 hours | F | F | F | F | F | F |

Exs 13-15 and Comp Ex K

OSP Concentration Variation and Reference

Table 7 lists formulations for Exs 13-15 and Comp Ex K and test results for ASTM D665B testing over 4 hours, 24 hours and 48 hours. The formulations all include calcium salt corrosion inhibitor. The Exs include different concentrations of OSP to determine if the concentration has an effect on performance.

Comp Ex K is a commercially available compressor lubricant sold under the tradename SULLUBE 32 and that is derived from a PAG (PO homo-polymer), a polyol ester and a barium salt of dinonylnaphthalene sulphonate Numerical values are wt % of a 400 g formulation for each component. Corrosion test results are either pass (P) or fail (F).

TABLE 7

| Component | Ex 13 | Ex 14 | Ex 15 | Comp Ex K |
|---|---|---|---|---|
| SYNALOX 100-20B | 44.44 | 41.94 | 36.94 | Sullube 32 |
| SYNALOX 100-30B | 44.44 | 41.94 | 36.94 | |
| UCON OSP-32 | 5 | 10 | 20 | |
| IRGANOX L57 | 5 | 5 | 5 | |
| Tolyltriazole | 0.12 | 0.12 | 0.12 | |
| Na-Sul Ca-1089 | 1 | 1 | 1 | |
| ASTM D665B Test Results | | | | |
| 4 hours | P | P | P | P |
| 24 hours | P | P | P | P |
| 48 hours | F | F | F | F |

Results reveal that the concentration of OSP does not significantly affect corrosion inhibition over a range of 5-20 wt % in these formulations when the calcium salt corrosion inhibitor is at one wt % of the formulation weight. Results also reveal that the inventive formulations perform as well as the commercially available formulations comprising polyol ester and barium corrosion inhibitor.

Ex 16

Different Calcium Corrosion Inhibitor

Comp Ex C was repeated except one wt % of Na-Sul Ca-50 was used instead of Na-Sul 611 and the concentration of UCON LB-165 was reduced by 0.5% to 66.48%. Na-Sul Ca-50 is a calcium salt of dinonylnaphthalene sulphonate but does not contain any carboxylate fraction. The resulting formulation (Ex 16) passed the ASTM D665A corrosion testing. This result indicates that the type of calcium salt of dinonylnaphthalene sulphonate is likely not critical to the improved corrosion inhibition characteristic of the present invention.

Elastomer Swelling Testing

Several different molecular weight alcohol-initiated propylene oxide and butylene oxide copolymer OSPs were tested for their ability to swell nitrile butadiene rubber (grade type 72 NBR 902). Testing was done using DIN ISO 1817 test method in which the elastomer is fully submerged in the OSP for a period of 1000 hours at a temperature of 100° C. The extent of the volume increase in the elastomer is reported. The OSPs are those commercially available under the trade name UCON from The Dow Chemical Company. Testing results are shown in Table 8.

TABLE 8

| | Average Molecular Weight of OSP (g/mol) | Percent Volume Change of NBR |
|---|---|---|
| UCON OSP-18 | 500 | 19 |
| UCON OSP-32 | 760 | 16 |
| UCON OSP-68 | 1400 | 0 |
| UCON OSP-150 | 1900 | −7 |
| UCON OSP-220 | 2300 | −9 |

Test results reveal that when this particular OSP has a molecular weight below 1400 g/mol it swells the NBR, when it has a molecular weight of 1400 g/mol it neither swells nor shrinks the NBR and when the OSP has a molecular weight of 1900 g/mol it shrinks NBR. Test results apply to this particular OSP, which is an alcohol (dodecanol) initiated PO/BO random copolymer with a 50/50 weight ratio of PO to BO. Different results are possible with different OSPs.

What is claimed is:

1. A lubricant comprising alcohol initiated propylene oxide homopolymer, wherein the alcohol initiated propylene oxide homopolymer is a butanol initiated propylene oxide homopolymer present at greater than 50 weight-percent based on a total lubricant weight, an oil soluble polyalkylene glycol other than the alcohol initiated propylene oxide homopolymer wherein the oil soluble polyalkylene glycol is an alcohol initiated random copolymer of propylene oxide and butylene oxide, and the oil soluble polyalkylene glycol is present in a range of 5 to 20 weight-percent based on the total lubricant weight and a calcium salt of dinonylnaphthalene sulphonate present in a range from 0.25 to one weight-percent based on the total lubricant weight, where the lubricant is further characterized by containing less than ten weight-percent of polyol esters based on total lubricant weight and the oil soluble polyalkylene glycol other than the alcohol initiated propylene oxide homopolymer being an alcohol initiated random copolymer of propylene oxide and butylene oxide and further characterized by providing no change in volume or an increase in volume of nitrile butadiene rubber as measured in accordance with DIN ISO 1817.

2. The lubricant of claim 1, where the lubricant is further characterized by the oil soluble polyalkylene glycol other than the alcohol initiated propylene oxide homopolymer having a number average molecular weight of less than 1400 grams per mole.

3. The lubricant of claim 1, where the lubricant is further characterized by being free of barium-containing materials.

4. The lubricant of claim 1, where the oil soluble polyalkylene glycol other than the alcohol initiated propylene oxide homopolymer is a dodecanol initiated random copolymer of propylene oxide and butylene oxide where the propylene oxide and butylene oxide are copolymerized at a 50/50 weight ratio.

5. A method for lubricating a compressor, the method comprising the step of adding to the compressor the lubricant of claim 1.

6. The method of claim 5, where the compressor is a rotary screw air compressor.

7. The lubricant of claim 1, wherein the lubricant passes the ASTM D665-12 corrosion test A.

8. The lubricant of claim 7, wherein the lubricant passes the ASTM D665-12 corrosion test B at a time of four hours.

9. The lubricant of claim 1, wherein the lubricant is further characterized by the oil soluble polyalkylene glycol other than the alcohol initiated propylene oxide homopolymer having a number average molecular weight in a range from 500 to 1400 grams per mole.

10. The lubricant of claim 1, wherein the alcohol initiated random copolymer of propylene oxide and butylene oxide is further characterized by butylene oxide being present in a range of from 40 to 80 weight percent based on a total weight of the propylene oxide and butylene oxide copolymer.

11. The lubricant of claim 1, wherein the alcohol initiated random copolymer of propylene oxide and butylene oxide is further characterized by butylene oxide being present at 50 percent based on a total weight of the propylene oxide and butylene oxide copolymer.

* * * * *